US008828131B2

(12) United States Patent
Yamamoto et al.

(10) Patent No.: US 8,828,131 B2
(45) Date of Patent: Sep. 9, 2014

(54) CATALYST APPLICATION SOLUTION, ELECTROLESS PLATING METHOD USING SAME, AND DIRECT PLATING METHOD

(75) Inventors: Hisamitsu Yamamoto, Hirakata (JP); Tetsuji Ishida, Hirakata (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 13/394,380

(22) PCT Filed: Aug. 5, 2010

(86) PCT No.: PCT/JP2010/063241

§ 371 (c)(1),
(2), (4) Date: Mar. 6, 2012

(87) PCT Pub. No.: WO2011/030638

PCT Pub. Date: Mar. 17, 2011

(65) Prior Publication Data

US 2012/0171363 A1 Jul. 5, 2012

(30) Foreign Application Priority Data

Sep. 11, 2009 (JP) ..... 2009-210190

(51) Int. Cl.

| | |
|---|---|
| ***C23C 18/30*** | (2006.01) |
| ***C23C 18/44*** | (2006.01) |
| ***H05K 3/18*** | (2006.01) |
| ***B05D 3/10*** | (2006.01) |
| ***C23C 18/16*** | (2006.01) |
| ***C23C 18/42*** | (2006.01) |
| ***C23C 18/20*** | (2006.01) |
| ***C25D 5/54*** | (2006.01) |

(52) U.S. Cl.

CPC ..... *C23C 18/42* (2013.01); *C23C 18/1608* (2013.01); *C23C 18/1641* (2013.01); *C23C 18/30* (2013.01); *C23C 18/1637* (2013.01); *C23C 18/2086* (2013.01); *C25D 5/54* (2013.01); *C23C 18/1653* (2013.01)

USPC ..... 106/1.11; 427/99.1; 427/304

(58) Field of Classification Search

USPC ..... 106/1.11, 1.21, 1.28; 427/99.1, 304

See application file for complete search history.

(56) References Cited

U.S. PATENT DOCUMENTS

| | | | | | |
|---|---|---|---|---|---|
| 3,011,920 | A | | 12/1961 | Shipley, Jr. | |
| 3,099,608 | A | * | 7/1963 | Radovsky et al. | 205/123 |
| 3,682,671 | A | * | 8/1972 | Zeblisky | 106/285 |
| 3,958,048 | A | * | 5/1976 | Donovan et al. | 427/304 |
| 3,961,109 | A | * | 6/1976 | Kremer et al. | 427/304 |
| 4,001,470 | A | * | 1/1977 | Schulze-Berge | 427/304 |
| 4,004,051 | A | * | 1/1977 | Kadison et al. | 427/304 |
| 4,634,468 | A | | 1/1987 | Gulla et al. | |
| 4,652,311 | A | | 3/1987 | Gulla et al. | |
| 4,725,314 | A | | 2/1988 | Gulla et al. | |
| 6,325,910 | B1 | * | 12/2001 | Meyer et al. | 205/159 |
| 7,166,152 | B2 | * | 1/2007 | Okuhama et al. | 106/1.11 |
| 2010/0059386 | A1 | * | 3/2010 | Yamamoto | 205/164 |

FOREIGN PATENT DOCUMENTS

| | | | |
|---|---|---|---|
| JP | 61-166977 | A | 7/1986 |
| JP | 07-106736 | A | 4/1995 |
| JP | 08-316612 | A | 11/1996 |
| JP | 2004-323879 | A | 11/2004 |
| JP | 2007-016283 | A | 1/2007 |

OTHER PUBLICATIONS

International Search Report of PCT/JP2010/063241, dated Sep. 27, 2010.

* cited by examiner

*Primary Examiner* — Helene Klemanski
(74) *Attorney, Agent, or Firm* — Westerman, Hattori, Daniels & Adrian, LLP

(57) ABSTRACT

Disclosed is a catalyst application solution for plating an insulating portion of an object to be plated that comprises the insulating portion. The catalyst application solution is characterized by containing a water-soluble palladium compound, a reducer, a dispersant, catechol, a copper antioxidant and a buffering agent, and by having a pH of not less than 4. When the catalyst application solution is compared with a Pd—Sn colloidal solution, the catalyst application solution has the following advantages: since the catalyst application solution is a colloidal solution of Pd only that does not contain Sn, a pre-dip process and an Sn removal process are unnecessary and thus the catalyst application process can be simplified; since the catalyst application solution has a pH of not less than 4, haloing does not occur; and since the catalyst application solution is in a reducing atmosphere due to the reducer contained therein, a copper surface is not oxidized and no copper dissolution occurs, thereby causing no palladium displacement reaction.

14 Claims, No Drawings

CATALYST APPLICATION SOLUTION, ELECTROLESS PLATING METHOD USING SAME, AND DIRECT PLATING METHOD

TECHNICAL FIELD

The present invention relates to a catalyst application solution for forming a plating film on an insulating portion of a printed wiring board, a package board, a decorative object, etc. and an electroless plating method and a direct plating method using the same.

BACKGROUND ART

Conventionally base plating for an insulating portion of a printed wiring board etc. is carried out based mainly on an electroless copper plating process. Meanwhile, many processes using the direct plating method, in which electroplating is carried out without performing the electroless copper plating, also exist in recent years. Examples of the general electroless plating process for plating the insulating portion include cleaning treatment→etching treatment→catalyst application treatment→electroless plating treatment. Furthermore, examples of the process using the direct plating method include cleaning treatment→etching treatment→catalyst application treatment→electrical-conductor layer forming treatment→electroplating treatment.

The catalyst application treatment is treatment of forming catalyst nuclei (Pd, Au, Ag, Pt, etc.) necessary for deposition of electroless plating on an insulating portion surface. For example, a method of forming palladium metal nuclei on an insulating portion surface by using a Pd—Sn colloidal solution or an alkaline palladium ion solution is known (Patent Document 1: U.S. Pat. No. 3,011,920).

If the Pd—Sn colloidal solution is used for the catalyst application treatment, treatment of removing Sn as a protective film (accelerator) is necessary after the catalyst application. If the accelerator is omitted, possibly the palladium catalytic activity is lowered and the plating reactivity decreases. Furthermore, possibly the connection reliability between the inner-layer copper and laminated copper, and the plating film is lowered.

A saturated halogen is necessary to stably keep the Pd—Sn colloid in the catalyst application solution, and generally the halogen concentration is adjusted by NaCl. However, a crystal (generally NaCl crystal) is often generated in a plating apparatus because of long-term use and corrosion of metal parts and troubles in operation of the apparatus often occur.

If the Pd—Sn colloidal solution is used for the catalyst application treatment, the colloidal metal is kept by divalent Sn (colloid protective film). When this divalent Sn is oxidized to quadrivalent Sn due to liquid circulation, possibly the characteristics of the colloid protective film are lost. Therefore, there is a problem that it is difficult to apply the Pd—Sn colloidal solution to an apparatus that requires strong liquid circulation like horizontal conveying apparatus. Furthermore, divalent Sn is oxidized to quadrivalent Sn due to entrained water in water rinse of pre-treatment and possibly the characteristics of the colloid protective film are lost. Therefore, pre-dip treatment needs to be performed between the water rinse and the Pd—Sn colloidal solution treatment to replace water on the surface of the object to be plated by a halide ion solution to thereby prevent the entrained water.

If the object to be plated is a substrate composed of an insulating portion and a copper portion like a printed wiring board, haloing due to dissolution of laminated copper inside a through-hole occurs and the substrate reliability is lowered in some cases. The haloing refers to the following phenomenon. An oxide of blackening treatment used for adhesion of a multilayer board is dissolved from an end of a hole due to permeation of the acid from the wall of the through-hole, so that a white or pink-like ring is generated at the periphery of the hole. If the haloing occurs, particularly in the case of a circuit in which through-holes are formed at high density, electrical contact with the adjacent through-hole on the circuit occurs. Furthermore, the adhesion between resins deteriorates, so that permeation of the catalyst application solution into the laminated portion and lamination separation (delamination) occur. The blackening treatment is to form a copper oxide film on the inner-layer copper surface and give minute recesses and projections in order to enhance the adhesion by lamination press of the inner-layer copper and the resin. By this treatment, the adhesion is enhanced based on the anchor effect.

Furthermore, displacement deposition of palladium on copper occurs due to dissolution of the copper on the substrate and the deposited palladium adversely affects the connection reliability between the laminated copper and the plating film in some cases. Moreover, the copper on the substrate dissolves into the catalyst application solution and thus renewal of the catalyst application solution is necessary, which leads to a problem of cost increase.

To solve these problems, a catalyst application solution composed of a strongly-acidic palladium colloidal solution that does not use Sn and contains an inorganic acid as solvent has been proposed (Patent Document 2: JP-A S61-166977). This palladium colloidal solution is strongly acidic although not using Sn. If the strongly-acidic palladium colloidal solution is used as the catalyst application solution for plating treatment for a printed wiring board, there is a problem that the acid in the solution dissolves the laminated copper of the printed wiring board. Furthermore, there is a problem that the dissolved copper ($Cu^{2+}$) is reduced by a reducer in the catalyst application solution to form a copper ($Cu^{0}$) colloid or adhere to the palladium colloid and exist as a colloid and therefore the activity as the catalyst in the electroless copper plating treatment is lowered.

On the other hand, if a conventional strongly-alkaline palladium ion solution is used as the catalyst application solution, reduction treatment (reducer) to reduce the palladium ion complex to the palladium metal is necessary (Patent Document 3: JP-A H8-316612). This is because the palladium ion complex itself does not act as the catalyst of electroless (copper) plating.

It is difficult to use the alkaline palladium ion solution for a base material that does not have alkali resistance (e.g. polyimide layer or adhesive layer portion) because the solution eats away the base material to cause abnormal plating and non-plating. Furthermore, the amount of palladium adsorption to the base material is about half compared with the case of using the Pd—Sn colloidal solution or the strongly-acidic palladium colloidal solution. In the case of a smooth base material having a small surface area, a non-plating problem occurs because necessary amount of palladium is insufficient due to instantaneous reaction of electroless copper plating.

Prior-art documents relating to the present invention include, besides the above-described documents, JP-A 2007-16283 (Patent Document 4).

SUMMARY OF THE INVENTION

Problems to be Solved by the Invention

The present invention is devised with focus on the catalyst application solution used in catalyst application treatment in order to solve the above-described problems. In particular, the object of the present invention is to provide such a catalyst application solution that copper is dissolved less readily even when a substrate is immersed in this solution and the lowering of the substrate reliability due to the occurrence of haloing does not occur in catalyst application treatment for a substrate composed of an insulating portion and a copper portion like a printed wiring board, and an electroless plating method and a direct plating method using the same.

Means for Solving the Problems

Normally a palladium colloidal solution is manufactured by reducing palladium ions to metal palladium by a reducer and turning it to colloids by a dispersant. In this case, a method of adding the reducer in the state in which the palladium is dissolved in a strongly-acidic solution (i.e. state of the palladium ion) to convert the palladium ions to the metal is used. Thus, the palladium colloidal solution is manufactured as a strongly-acidic solution. If the pH of the strongly-acidic palladium colloidal solution manufactured by the above-described method is set to at least 4, oxidation of the palladium readily occurs. This possibly causes aggregation and sedimentation of the palladium colloid and generation of copper hydroxide and the lowering of the solution stability due to oxidation of copper on the substrate surface. Therefore, when merely the pH of the conventional strongly-acidic palladium colloidal solution is set to at least 4, this solution does not become an effective palladium colloidal solution. Furthermore, the palladium colloidal solution whose pH is at least 4 has also a problem that the pH of the solution needs to be kept at a predetermined pH because continuation of use of this solution causes the lowering of the pH accompanying reaction decomposition of the reducer.

The present inventors have made studies earnestly in order to solve the above-described problems. As a result, the present inventors have achieved the following finding regarding a catalyst application solution that effectively acts with a pH in the range from weak acidity to weak alkalinity, particularly from weak acidity to the vicinity of neutrality, particularly a palladium colloidal solution, preferably a palladium colloidal solution that does not contain Sn. Specifically, by making the palladium colloidal solution contain catechol, oxidation of palladium that has become the colloidal state is controlled, and aggregation and sedimentation of the palladium colloid can be prevented even when the pH is set at least 4. Furthermore, the present inventors have found that copper oxidation can be controlled by the above-described palladium colloidal solution containing a copper-oxidation inhibitor. Moreover, by the palladium colloidal solution containing a buffering agent, the pH is kept at a pH that is at least 4 and in the range from weak acidity to weak alkalinity, particularly from weak acidity to the vicinity of neutrality, so that the solution becomes a catalyst application solution excellent in control of copper dissolution and the solution stability.

Therefore, the present invention provides the following catalyst application solution and an electroless plating method and a direct plating method using the same.

First Embodiment

A catalyst application solution for plating an insulating portion of an object to be plated comprising the insulating portion, the catalyst application solution being characterized by comprising the following components:

(A) a water-soluble palladium compound;

(B) a reducer;

(C) a dispersant;

(D) a catechol;

(E) a copper-oxidation inhibitor; and (F) a buffering agent, and having a pH of at least 4.

Second Embodiment

The catalyst application solution of the first embodiment, wherein component (A) is a water-soluble palladium compound selected from palladium oxide, palladium chloride, palladium nitrate, palladium acetate, sodium palladium chloride, potassium palladium chloride, ammonium palladium chloride, palladium sulfate, and tetraammine palladium chloride, component (B) is a reducer selected from hypophosphorous acid and salt thereof, boron hydride and salt thereof, dimethylamine borane, and trimethylamine borane, component (C) is a dispersant selected from a polymer surfactant, an anionic surfactant, a cationic surfactant, and an amphoteric surfactant, component (E) is a copper-oxidation inhibitor selected from ascorbic acid, glyoxylic acid, phosphorous acid, sulfurous acid, and salts thereof, and formaldehyde, and component (F) is a buffering agent selected from citric acid, acetic acid, phosphoric acid, and salts thereof.

Third Embodiment

The catalyst application solution of the first or second embodiment, wherein concentration of component (A) is 0.0001 to 0.01 mol/L, concentration of component (B) is 0.005 to 1 mol/L, concentration of component (C) is 0.01 to 10 g/L, concentration of component (D) is 0.01 to 50 g/L, concentration of component (E) is 0.001 to 0.5 mol/L, and concentration of component (F) is 0.005 to 0.5 mol/L.

Fourth Embodiment

The catalyst application solution of any one of the first to third embodiments, characterized by being for electroless plating.

Fifth Embodiment

The catalyst application solution of any one of the first to third embodiments, characterized by being for direct plating.

Sixth Embodiment

An electroless plating method for carrying out electroless plating for an insulating portion of an object to be plated comprising the insulating portion, the method being characterized in that a palladium catalyst is applied to a surface of the insulating portion by performing palladium catalyst application treatment for a surface of the object to be plated by using the catalyst application solution of any one of the first to third embodiments, and thereafter, an electroless plating film is formed on the surface of the insulating portion to which the palladium catalyst is applied.

Seven Embodiment

A direct plating method for carrying out electroplating for an insulating portion of an object to be plated comprising the insulating portion, the method being characterized in that a palladium catalyst is applied to a surface of the insulating portion by performing palladium catalyst application treatment for a surface of the object to be plated by using the catalyst application solution of any one of the first to third embodiments, thereafter, a palladium electrical-conductor layer is formed on the insulating portion by a palladium electrical-conductor layer forming solution comprising a palladium compound, an amine compound, and a reducer with use of the applied palladium as a catalyst, and thereafter, an electroplating film is formed directly on the palladium electrical-conductor layer.

Advantageous Effect of the Invention

When being compared with the Pd—Sn colloidal solution, the catalyst application solution of the present invention has the following advantages. Specifically, because it is a colloidal solution of Pd alone that does not contain Sn, the above-described pre-dip treatment and Sn removal treatment are unnecessary and thus catalyst application treatment can be simplified. Furthermore, because the pH is at least 4, haloing does not occur. Moreover, because the palladium colloidal solution is in a reducing atmosphere due to the reducer therein, a copper surface is not oxidized and copper dissolution does not occur. Thus, palladium displacement reaction does not occur.

Furthermore, compared with the alkaline palladium ion solution, the catalyst application solution of the present invention has the following advantages. Specifically, the amount of palladium adsorption is as large as about 10 times and reduction treatment is also unnecessary. In addition, it can be used also for a material that is not an alkali-resistant material (polyimide etc.). Furthermore, compared with the strongly-acidic palladium colloidal solution, there are the following advantages. Specifically, haloing does not occur and the catalyst application solution is unsusceptible to the influence of copper on the substrate surface. In addition, material corrosion to metal and resin is very little.

EMBODIMENT FOR CARRYING OUT THE INVENTION

The present invention will be described in detail below.

The catalyst application solution of the present invention is a catalyst application solution for plating an insulating portion of an object to be plated including the insulating portion, and is a solution that contains the following components:

(A) water-soluble palladium compound;

(B) reducer;

(C) dispersant;

(D) catechol;

(E) copper-oxidation inhibitor; and (F) buffering agent, and has a pH of at least 4.

(A) Palladium Compound

In the present invention, the palladium compound is a water-soluble (soluble in an aqueous solution of the catalyst application solution of the present invention) compound and a commonly-known material can be used. Examples of the palladium compound include water-soluble palladium compounds such as palladium oxide, palladium chloride, palladium nitrate, palladium acetate, sodium palladium chloride, potassium palladium chloride, ammonium palladium chloride, palladium sulfate, and tetraammine palladium chloride.

The concentration of the palladium compound is preferably 0.0001 to 0.01 mol/L and more preferably 0.0005 to 0.002 mol/L. When the concentration is lower than 0.0001 mol/L, the necessary amount of palladium adsorption for forming an electroless plating film may not be obtained. Furthermore, concentration beyond 0.01 mol/L takes high cost and is impractical in terms of the economical aspect.

(B) Reducer

In the present invention, the reducer has actions to generate palladium colloids and retain the palladium colloids. As the reducer, a commonly-known material can be used. Examples of the reducer include hypophosphorous acid and salt thereof, boron hydride and salt thereof (e.g. sodium salt, potassium salt, and ammonium salt as the salts), dimethylamine borane, and trimethylamine borane.

The above-described reducer functions as a reducer for the palladium ion. The concentration thereof is preferably 0.005 to 1 mol/L and more preferably 0.01 to 0.5 mol/L. Concentration lower than 0.005 mol/L possibly lowers the colloid generation ability and retention ability. When the concentration surpasses 1 mol/L, possibly the reduction ability becomes excessive and the catalyst application solution becomes unstable.

(C) Dispersant

In the present invention, the dispersant functions to prevent aggregation and sedimentation of the palladium colloid. As the dispersant, a commonly-known material can be used. Examples of the dispersant include a polymer surfactant such as polyethylene glycol, polyvinylpyrrolidone, polyvinyl alcohol, polyethyleneimine, and polyacrylic acid, an anionic surfactant such as sodium dodecyl sulfate, a cationic surfactant, and an amphoteric surfactant. In particular, polyvinylpyrrolidone is preferable.

The concentration of the dispersant is preferably 0.01 to 10 g/L and more preferably 0.1 to 5 g/L. If the concentration is lower than 0.01 g/L, possibly aggregation and sedimentation of the palladium colloid occur. Furthermore, if the concentration surpasses 10 g/L, there is no problem as long as the dispersant is dissolved. However, such concentration is impractical in terms of the cost.

(D) Catechol

In the present invention, catechol functions to control oxidation of palladium that has become the colloidal state and prevent aggregation and sedimentation of the palladium colloid. The concentration of the catechol is preferably 0.01 to 50 g/L and more preferably 0.05 to 20 g/L. If the concentration is lower than 0.01 g/L, possibly aggregation and sedimentation of the palladium colloid occur. Furthermore, if the concentration surpasses 50 g/L, possibly the amount of palladium adsorption to the base material is decreased and economic efficiency is also deteriorated.

(E) Copper-Oxidation Inhibitor

In the present invention, the copper-oxidation inhibitor has effects to prevent copper dissolution and control generation of copper colloid and copper hydroxide. As the copper-oxidation inhibitor, a commonly-known material having a reduction action for copper can be used. Examples of the copper-oxidation inhibitor include formaldehyde (formalin), ascorbic acid, glyoxylic acid, phosphorous acid, sulfurous acid, and salts of them (e.g. sodium salt, potassium salt, and ammonium salt). In particular, ascorbic acid is preferable because it is excellent in the effect to prevent copper oxidation and has little influence on the stability of the palladium colloid (aggregation and sedimentation). The concentration of the copper-oxidation inhibitor is preferably 0.001 to 0.5 mol/L and more preferably 0.003 to 0.3 mol/L. If the concentration is lower than 0.001 mol/L, possibly the oxidation prevention effect is not obtained. On the other hand, if the concentration surpasses 0.5 mol/L, possibly catechol as component (D) does not sufficiently act and aggregation and sedimentation of the palladium colloid occur.

(F) Buffering Agent

In the present invention, the buffering agent functions to keep the pH of the catalyst application solution. Examples of the buffering agent include citric acid, acetic acid, phosphoric acid, and salts of them (e.g. sodium salt, potassium salt, and ammonium salt). In particular, phosphate is preferable. The concentration of the buffering agent is preferably 0.005 to 0.5 mol/L and more preferably 0.03 to 0.3 mol/L. If the concentration is lower than 0.005 mol/L, a pH of at least 4 cannot be kept in some cases. Besides, possibly the copper-oxidation inhibitor as component (E) does not sufficiently act and copper dissolution progresses. On the other hand, if the concentration surpasses 0.5 mol/L, possibly catechol as component (D) does not sufficiently act and aggregation and sedimentation of the palladium colloid occur.

(G) Other Components

To the catalyst application solution of the present invention, other components may be added besides the above-described components (A) to (F). Specifically, a halogen ion such as $Cl^-$ may be added (for example added by NaCl) to keep the bath stability, and e.g. an acid such as hydrochloric acid and a base such as NaOH may be added for pH adjustment. However, a solution that does not contain Sn (Sn compound) is preferable as the catalyst application solution of the present invention. Therefore, Sn (Sn compound) had better not be added. The concentration of other components can be set to arbitrary concentration as long as the effects of the catalyst application solution of the present invention are not spoiled.

The catalyst application solution of the present invention is used with a pH of at least 4, particularly a pH in the range from weak acidity to weak alkalinity, especially from weak acidity to the vicinity of neutrality. More specifically, it is used preferably with a pH of at least 4.5 and more preferably with a pH of at least 5, and it is used preferably with a pH of up to 9 and more preferably with a pH of up to 8. In this pH range, favorable palladium metal nuclei can be formed. If the pH is lower than 4, copper dissolution occurs. Thus, the amount of palladium adsorption to the base material is decreased due to colloid aggregation and copper colloid generation and the catalytic activity is lowered. Furthermore, the catechol as component (D) and the copper-oxidation inhibitor as component (E) do not sufficiently act. On the other hand, there is no problem even when the pH surpasses 9. However, if the substrate does not have alkali resistance, possibly the substrate is corroded. The treatment temperature is preferably 20 to 80° C. In particular, at a temperature of at least 40° C., the optimum palladium metal nuclei can be formed in a short time. If the treatment temperature is lower than 20° C., the optimum palladium metal nuclei cannot be formed in some cases. On the other hand, possibly a temperature beyond 80° C. lowers the stability of the catalyst application solution. The treatment time with the catalyst application solution is normally 0.5 to 15 minutes and preferably 1 to 10 minutes.

The catalyst application solution of the present invention can be favorably used for pre-treatment of electroless plating. The electroless plating method of the present invention is to form an electroless plating film on an insulating portion of an object to be plated including the insulating portion. In the method, a palladium catalyst is applied to the surface of the above-described insulating portion by performing palladium catalyst application treatment for this insulating portion of the object to be plated by using the above-described catalyst application solution. Thereafter, an electroless plating film is formed with use of this applied palladium as a catalyst.

A commonly-known method can be employed as the pre-treatment method before the above-described palladium catalyst application treatment. For example, in the case of a printed wiring board having a copper film, the following method is employed. Specifically, conditioning (cleaner conditioner) by an alkaline cleaner, such as an amine compound, containing a non-ionic activator or a cationic activator is performed. Then, copper etching (soft etching) is performed by an etchant containing an oxidizing agent and an acid. Furthermore, acid rinse is performed.

The palladium catalyst application treatment for the object to be plated is performed by using the above-described catalyst application solution. It is enough that merely the object to be plated for which the pre-treatment before the palladium catalyst application treatment is performed is immersed in the above-described catalyst application solution for a predetermined time and then water rinse is performed. In the present invention, pre-dip treatment may be performed before the treatment by the catalyst application solution. However, the treatment can be directly performed without the pre-dip treatment. Because the catalyst application solution of the present invention does not contain Sn, the process can be forwarded to electroless plating treatment without performing Sn removal treatment like in the conventional technique.

After the palladium catalyst application treatment, electroless plating is performed. Examples of the electroless plating include commonly-known electroless plating of copper, nickel, and gold. A commonly-known composition can be employed for the plating bath used in the electroless plating and a commercial product can be used. Furthermore, the plating conditions may also be normal commonly-known conditions.

Furthermore, the catalyst application solution of the present invention can be favorably used also for a direct plating method in which electroless copper plating treatment is not performed. In the direct plating method of the present invention, a palladium catalyst is applied to the surface of an insulating portion of an object to be plated by the above-described method. Then, with use of this applied palladium as a catalyst, a palladium electrical-conductor layer is formed on the above-described insulating portion by a palladium electrical-conductor layer forming solution containing a palladium compound, an amine compound, and a reducer. Thereafter, an electro copper plating film is formed by performing electroplating directly on this palladium electrical-conductor layer on the insulating portion. Examples of the electroplating include electro copper plating. A commonly-known composition can be employed for the plating bath. In particular, copper sulfate plating is preferable.

As the above-described palladium electrical-conductor layer forming solution, e.g. a solution described in Patent Document 4 (JP-A 2007-16283) can be used.

Examples of the palladium electrical-conductor layer forming solution containing a palladium compound, an amine compound, and a reducer is as follows. As the palladium compound used, a commonly-known material can be used. Examples of the palladium compound include water-soluble (soluble in an aqueous solution of the palladium electrical-conductor layer forming solution) palladium compounds such as palladium oxide, palladium chloride, palladium nitrate, palladium acetate, sodium palladium chloride, potassium palladium chloride, ammonium palladium chloride, palladium sulfate, and tetraammine palladium chloride. The use concentration of the above-described palladium compound is preferably in the range of 0.0001 to 0.01 mol/L and most preferably 0.0005 to 0.002 mol/L.

Furthermore, for such a palladium electrical-conductor layer forming solution, at least one kind of amine compound is used in order to stably form and maintain a palladium complex. Moreover, to maintain the pH of the palladium electrical-conductor layer forming solution around 7, preferably a compound that stably forms the complex at this pH is selected. The concentration of the amine compound is preferably 0.0001 to 0.1 mol/L and more preferably 0.001 to 0.02 mol/L.

Examples of the above-described amine compound include monoamines such as methylamine, ethylamine, propylamine, trimethylamine, and dimethylethylamine, diamines such as methylenediamine, ethylenediamine, tetramethylenediamine, and hexamethylenediamine, polyamines such as diethylenetriamine, triethylenetetramine, and pentaethylenehexamine, and other amino acids such as ethylenediaminetetraacetic acid and sodium salt, potassium salt, and ammonium salt thereof, nitrilotriacetic acid and sodium salt, potassium salt, and ammonium salt thereof, glycine, and iminodiacetic acid.

Furthermore, it is desirable to add an aliphatic carboxylic acid to the palladium electrical-conductor layer forming solution for stability enhancement. Examples of the aliphatic carboxylic acid include monocarboxylic acids such as formic acid, acetic acid, propionic acid, butyric acid, isobutyric acid, valeric acid, and isovaleric acid, dicarboxylic acids such as oxalic acid, malonic acid, succinic acid, glutaric acid, maleic acid, fumaric acid, citraconic acid, and itaconic acid, other carboxylic acids such as tricarballylic acid, glycolic acid, lactic acid, malic acid, tartaric acid, citric acid, isocitric acid, alloisocitric acid, gluconic acid, oxalacetic acid, and diglycolic acid, and sodium salt, potassium salt, and ammonium salt of these carboxylic acids. One or more kinds of the above-described carboxylic acid and salt thereof can be used. The concentration thereof is preferably 0.0001 to 0.1 mol/L and more preferably 0.001 to 0.02 mol/L.

A commonly-known material can be used as the reducer. Examples of the reducer include hypophosphorous acid, boron hydride, and salts of them (e.g. sodium salt, potassium salt, and ammonium salt), dimethylamine borane, trimethylamine borane, and hydrazines.

The above-described reducer functions as a reducer for the palladium ion in the palladium electrical-conductor layer forming solution. The concentration thereof is preferably 0.01 to 1 mol/L and more preferably 0.05 to 0.5 mol/L.

It is more preferable to add an azole compound to the palladium electrical-conductor layer forming solution in order to avoid forming of a palladium electrical-conductor layer on the copper portion surface of the object to be plated. The azole compound adsorbs on copper and controls copper dissolution due to amine. Thereby, palladium displacement reaction onto the copper is controlled and the palladium electrical-conductor layer can be formed only on the insulating portion.

In this case, examples of the azole compound include imidazoles such as imidazole, 2-phenylimidazole, 1-vinylimidazole, benzimidazole, 2-butylbenzimidazole, 2-phenylethyl benzimidazole, and 2-aminobenzimidazole, triazoles such as 1,2,4-triazole, 3-amino-1,2,4-triazole, 1,2,3-benzotriazole, 1-hydroxybenzotriazole, and carboxybenzotriazole, tetrazoles such as tetrazole, 5-phenyl-1H-tetrazole, 5-methyl-1H-tetrazole, and 5-amino-1H-tetrazole, pyrazole, and benzothiazole. In particular, 1,2,3-benzotriazole is preferable.

Two or more kinds of the above-described azole compound may be used in combination. The concentration of the azole compound is preferably 0.0001 to 0.2 mol/L and more preferably 0.0002 to 0.02 mol/L.

The palladium electrical-conductor layer forming solution is used preferably with a pH of up to 8, particularly with a pH in the range of 6 to 8. In this pH range, a favorable palladium electrical-conductor layer can be formed. The solution can be used in the treatment temperature range of 20 to 80° C. In particular, at a temperature of at least 40° C., a favorable palladium electrical-conductor layer can be formed in a short time. The treatment time with the palladium electrical-conductor layer forming solution is preferably 0.5 to 5 minutes and particularly about 1 to 3 minutes. Furthermore, it is preferable to form the palladium electrical-conductor layer with a film thickness of about 5 to 50 nm.

In the direct plating method, the object to be plated for which the palladium catalyst application treatment is performed is immersed in the above-described palladium electrical-conductor layer forming solution for a predetermined time to form the palladium electrical-conductor layer. Furthermore, after the palladium electrical-conductor layer is formed in this manner, electroplating such as electro copper plating is performed. In this case, because the palladium electrical-conductor layer is formed on the insulating portion of the object to be plated, electroplating such as electro copper plating is performed directly on the palladium electrical-conductor layer without further performing electroless plating for the insulating portion, and an electroplating film such as an electro copper plating film can be formed.

A commonly-known composition can be employed for the plating bath used for the electroplating and a commercial product can be used. Furthermore, the plating conditions may also be normal commonly-known conditions.

EXAMPLES

The present invention will be specifically described below by showing Examples and Comparative Examples. However, the present invention is not limited to the following Examples.

Examples 1 to 6 and Comparative Examples 1 to 6

Preparation of Palladium Colloidal Solutions

Stability of Solution

Palladium colloidal solutions were prepared with compositions described in Table 1. After the preparation, the palladium colloidal solutions were allowed to stand at 40° C. for 10 hours and then the state of the palladium colloidal solutions was visually observed. No particular change was found in the solutions of Examples 1 to 6 and Comparative Examples 2 and 3. However, in the solution of Comparative Example 1, which did not contain catechol, the palladium colloids aggregated and settled out. Therefore, the solution of Comparative Example 1 was not used for the following Evaluations 1 and 2.

<Evaluation 1: Measurement of Amount of Copper Dissolution (Dissolution Rate)>

A commercial product FR-4 (surface-laminated copper foil) was immersed in the solutions for 5 hours with bath loading of 10 $dm^2$/L at the following respective temperatures: 40° C. for the solutions of Examples 1 to 6 and Comparative Examples 2 and 3 in Table 1 or Comparative Example 5 in Table 2; 30° C. for the solution of Comparative Example 4 in Table 2; and 60° C. for the solution of Comparative Example 6 in Table 2. Thereafter, the copper concentration in the solution was measured by atomic absorption analyzing apparatus (polarized Zeeman atomic absorption photometer Z-5300 made by Hitachi, Ltd.). The results are shown in Table 1 and Table 2.

In Examples 1 to 6, the copper concentration in the solution (dissolution rate) was up to 0.3 ppm/hr (μg/dm$^2$/hr) and copper was hardly dissolved. This would be because the solutions of Examples 1 to 6 had a pH of at least 4 and contained the copper-oxidation inhibitor. On the other hand, in Comparative Example 6, which was a conventional alkaline Pd ion solution, a copper oxide film was generated on the sample copper foil surface although copper dissolution was not found in the solution. In Comparative Examples 2 and 3, the copper concentration in the solution (dissolution rate) was 0.8 ppm/hr and more than twice as much copper as that in the solutions of Examples 1 to 6 was dissolved. In the solution of Comparative Example 2, which had a pH of at least 4 but did not contain the copper-oxidation inhibitor, copper was dissolved slightly. Furthermore, in the solution of Comparative Example 3, the copper-oxidation inhibitor was contained but the buffering agent was not added. Therefore, the pH was up to 4. Thus, the oxidation dissolution rate was high and the equivalent amount of copper as that in Comparative Example 2 was dissolved. The solution of Comparative Example 4, which was the Pd—Sn colloidal solution, was strongly acidic. Therefore, the copper concentration in the solution (dissolution rate) was 56.8 ppm/hr and the largest amount of copper was dissolved. In Comparative Example 5, which was a strongly-acidic palladium colloidal solution that had a pH up to 4 and did not contain the copper-oxidation inhibitor, the copper concentration in the solution (dissolution rate) was 1.0 ppm/hr.

<Evaluation 2: Measurement of Amount of Palladium Adsorption>

For a commercial product FR-4 having a surface-laminated copper foil and a sample obtained by completely dissolving the surface-laminated copper foil of the commercial product FR-4 (i.e. sample in which resin was exposed across the whole surface), catalyst application treatment was performed by using the catalyst application solutions of Table 1 (Examples 1 to 6 and Comparative Examples 2 and 3) or Table 2 (Comparative Examples 4 to 6). The sample was treated in accordance with the following processes: a process of Table 3 for the solutions of Examples 1 to 6 and Comparative Examples 2, 3, and 5, which were the palladium colloidal solution; a process of Table 4 for the solution of Comparative Example 4, which was the Pd—Sn colloidal solution; and a process of Table 5 for the solution of Comparative Example 6, which was the alkaline Pd ion solution. The sample after the treatment was immersed in a 1:1 aqua regia to completely dissolve the palladium on the surface. Then, the amount of palladium adsorption was measured by atomic absorption. The results are shown in Table 1 and Table 2. It is preferable that the amount of palladium adsorption be large on the resin and be small on the copper for the connection reliability between the laminated copper and the plating film.

In the case of the solutions of Examples 1 to 6 and Comparative Examples 2, 3, and 5 (strongly-acidic palladium colloidal solution), the amount of palladium adsorption on the resin was 197 to 339 ppm (μg/dm$^2$) and the palladium was favorably adsorbed onto the resin surface. On the other hand, the amount of palladium adsorption on the copper foil was up to 12 ppm. Thus, the connection reliability between the laminated copper and the plating film can be expected. This would be because of the following reason. Specifically, because the palladium colloidal solution was in a reducing atmosphere, the Pd ion hardly existed in the solution and the palladium displacement did not occur on the copper. On the other hand, in the case of the solution of Comparative Example 4 (Pd—Sn colloidal solution), 70 ppm of the palladium was adsorbed onto the resin. However, this was only half or less compared with the solution of Comparative Example 5 (strongly-acidic palladium colloidal solution). Moreover, in Comparative Example 4, the amount of palladium adsorption on the copper foil showed a high value, i.e. 30 ppm. This would be the following reason. Specifically, the Pd—Sn colloidal solution of Comparative Example 4 was a considerably-strongly-acidic solution, and the solution contained the palladium ion. Thus, palladium displacement occurred on the copper. In the case of the solution of Comparative Example 6 (alkaline Pd ion solution), the amount of palladium adsorption on the resin was 30 ppm, which was about ⅙ to 1/10 of the palladium colloidal solution. On the other hand, the amount of palladium adsorption on the copper foil was 20 ppm.

TABLE 1

| Composition | Example | | | | | | Comparative Example | | |
|---|---|---|---|---|---|---|---|---|---|
| (g/L) | 1 | 2 | 3 | 4 | 5 | 6 | 1 | 2 | 3 |
| Pd chloride | 0.33 | 0.33 | 0.33 | 0.33 | 0.33 | 0.33 | 0.33 | 0.33 | 0.33 |
| Hydrochloric acid (25%) | 0.01 | 0.03 | 0.03 | 0.03 | 0.03 | 0.03 | 0.03 | 0.03 | 0.03 |
| Na chloride | 1 | 1 | 1 | 1 | 1 | 1 | 1 | 1 | 1 |
| Di-Na hydrogen phosphate | 0.6 | — | — | — | — | — | — | — | — |
| Na dihydrogen phosphate | 1.6 | — | 1 | — | 10 | 15 | 15 | 15 | — |
| Na acetate | — | 10 | — | — | — | — | — | — | — |
| Na citrate | — | — | — | 1 | — | — | — | — | — |
| Polyvinylpyrrolidone | 1 | 1 | 1 | 1 | 1 | 1 | 1 | 1 | 1 |
| Ascorbic acid | 10 | 10 | — | — | — | — | — | — | — |
| Na ascorbate | — | — | — | 10 | 10 | 10 | 10 | — | 10 |
| HCHO | — | — | 2.8 | — | — | — | — | — | — |
| Catechol | 0.05 | 1 | 1 | 0.5 | 0.1 | 0.05 | — | 0.05 | 0.05 |
| Na hypophosphite | 2 | 5 | 10 | 10 | 10 | 10 | 10 | 10 | 10 |
| pH (25° C.) | 6.7 | 4.3 | 7.3 | 5.9 | 5.3 | 4.9 | 4.9 | 4.9 | 3.1 |
| Copper dissolution amount (ppm/hr) | 0.3 | 0.3 | 0.3 | 0.2 | 0.1 | 0.0 | — | 0.8 | 0.8 |
| Pd adsorption amount on resin (μg/dm$^2$) | 339 | 258 | 197 | 200 | 256 | 280 | — | 247 | 256 |
| Pd adsorption amount on copper foil (μg/dm$^2$) | 12 | 9 | 8 | 5 | 1 | 3 | — | 1 | 3 |

TABLE 2

| Composition | Comparative Example 4 (Pd—Sn colloidal solution) | Comparative Example 5 (strongly-acidic Pd colloidal solution) | Comparative Example 6 (alkaline Pd ion solution) |
|---|---|---|---|
| AT 105[1)] | 30 ml/L | | |
| PED-104[2)] | 270 g/L | — | — |
| WAT-EG[3)] | — | 100 ml/L | — |
| MAT-31[4)] | — | — | 50 ml/L |
| NaOH | — | — | 1.2 g/L |
| pH (25° C.) | 0.8 | 1.5 | 11.5 |
| Copper dissolution amount (ppm/hr) | 56.8 | 1.0 | 0.0 |
| Pd adsorption amount on resin (μg/dm$^2$) | 70 | 245 | 30 |
| Pd adsorption amount on copper foil (μg/dm$^2$) | 30 | 3 | 20 |

[1)]Pd—Sn colloidal solution
[2)]Pd—Sn colloidal solution stabilizer
[3)]acidic palladium colloidal solution
[4)]alkaline palladium complex solution
*all of chemicals [1)] to [4)] are made by C. Uyemura & Co., Ltd.

TABLE 3

| Process | Chemical name | Concentration | Temperature (° C.) | Time (minute) |
|---|---|---|---|---|
| 1. cleaner conditioner | WCD-FE[5)]<br>NaOH | 300 ml/L<br>5 g/L | 50 | 5 |
| 2. hot water rinse | | | 40 | 1 |
| 3. water rinse | | | RT | 1 |
| 4. soft etching | Na persulfate<br>Purified dilute sulfuric acid (62.5%) | 100 g/L<br>100 ml/L | 25 | 1 |
| 5. water rinse | | | RT | 1 |
| 6. acid rinse | Purified dilute sulfuric acid (62.5%) | 100 ml/L | RT | 1 |
| 7. water rinse | | | RT | 1 |
| 8. catalyst application (Pd colloid) | | | 40 | 5 |
| 9. water rinse | | | RT | 1 |

[5)]cleaner for Pd colloid made by C. Uyemura & Co., Ltd.

TABLE 4

| Process | Chemical name | Concentration | Temperature (° C.) | Time (minute) |
|---|---|---|---|---|
| 1. cleaner conditioner | MTE-1-A[6)] | 50 ml/L | 50 | 5 |
| 2. hot water rinse | | | 40 | 1 |
| 3. water rinse | | | RT | 1 |
| 4. soft etching | Na persulfate<br>Purified dilute sulfuric acid (62.5%) | 100 g/L<br>100 ml/L | 25 | 1 |
| 5. water rinse | | | RT | 1 |
| 6. acid rinse | Purified dilute sulfuric acid (62.5%) | 100 ml/L | RT | 1 |
| 7. water rinse | | | RT | 1 |
| 8. pre-dip | PED-104 | 270 g/L | RT | 2 |
| 9. catalyst application (Pd—Sn colloid) | | | 30 | 8 |
| 10. water rinse | | | RT | 1 |

TABLE 4-continued

| Process | Chemical name | Concentration | Temperature (° C.) | Time (minute) |
|---|---|---|---|---|
| 11. accelerator | AL-106[7)] | 100 ml/L | 25 | 3 |
| 12. water rinse | | | RT | 1 |

[6)]cleaner for Pd—Sn colloid made by C. Uyemura & Co., Ltd.
[7)]accelerator for Pd—Sn colloid made by C. Uyemura & Co., Ltd.

TABLE 5

| Process | Chemical name | Concentration | Temperature (° C.) | Time (minute) |
|---|---|---|---|---|
| 1. cleaner conditioner | MCC-6-A[8)] | 50 ml/L | 50 | 5 |
| 2. hot water rinse | | | 40 | 1 |
| 3. water rinse | | | RT | 1 |
| 4. soft etching | Na persulfate<br>Purified dilute sulfuric acid (62.5%) | 100 g/L<br>100 ml/L | 25 | 1 |
| 5. water rinse | | | RT | 1 |
| 6. acid rinse | Purified dilute sulfuric acid (62.5%) | 100 ml/L | RT | 1 |
| 7. water rinse | | | RT | 1 |
| 8. catalyst application (alkaline Pd ion) | | | 60 | 5 |
| 9. water rinse | | | RT | 1 |
| 10. reducer | MAB-4-A[9)]<br>MAB-4-C[10)] | 20 ml/L<br>100 ml/L | 35 | 3 |
| 11. water rinse | | | RT | 1 |

[8)]cleaner for alkaline Pd ion made by C. Uyemura & Co., Ltd.
[9)]reducer for alkaline Pd ion made by C. Uyemura & Co., Ltd.
[10)]reducer for alkaline Pd ion made by C. Uyemura & Co., Ltd.

Example 7

For a four-layer substrate formed by a commercial product FR-4 in which a through-hole was provided (0.3 mmϕ, 1.6 mmt), treatment by the palladium colloidal solution with the composition shown in Example 1 in Table 1 was performed in accordance with the process shown in Table 3. Thereafter, plating treatment was performed by an electroless copper plating bath PSY (made by C. Uyemura & Co., Ltd.) under a condition of 35° C. and 15 minutes. As a result, an electroless copper plating film was completely formed in the through-hole without problems. Furthermore, haloing did not occur around the through-hole.

Example 8

For a four-layer substrate formed by a commercial product FR-4 in which a through-hole was provided (0.3 mmϕ, 1.6 mmt), treatment by the palladium colloidal solution with the composition shown in Example 2 in Table 1 was performed in accordance with the process shown in Table 3. Thereafter, plating treatment was performed by an electroless copper plating bath PSY (made by C. Uyemura & Co., Ltd.) under a condition of 35° C. and 15 minutes. As a result, an electroless copper plating film was completely formed in the through-hole without problems. Furthermore, haloing did not occur around the through-hole.

Comparative Example 7

For a four-layer substrate formed by a commercial product FR-4 in which a through-hole was provided (0.3 mmϕ, 1.6 mmt), treatment by the Pd—Sn colloidal solution with the composition shown in Comparative Example 4 in Table 2 was performed in accordance with the process shown in Table 4. Thereafter, plating treatment was performed by an electroless copper plating bath PSY (made by C. Uyemura & Co., Ltd.) under a condition of 35° C. and 15 minutes. As a result, an electroless copper plating film was completely formed in the through-hole without problems. However, haloing was found around the through-hole.

Comparative Example 8

For a four-layer substrate formed by a commercial product FR-4 in which a through-hole was provided (0.3 mmϕ, 1.6 mmt), treatment by the palladium colloidal solution with the composition shown in Comparative Example 5 in Table 2 was performed in accordance with the process shown in Table 3. Thereafter, plating treatment was performed by an electroless copper plating bath PSY (made by C. Uyemura & Co., Ltd.) under a condition of 35° C. and 15 minutes. As a result, an electroless copper plating film was completely formed in the through-hole without problems. However, haloing was found around the through-hole.

Example 9

For a four-layer substrate formed by a commercial product FR-4 in which a through-hole was provided (0.3 mmϕ, 1.6 mmt), treatment by the palladium colloidal solution with the composition shown in Example 6 in Table 1 was performed in accordance with the process shown in Table 3. Thereafter, treatment was performed at 50° C. for 3 minutes by using a direct plating bath WPD (made by C. Uyemura & Co., Ltd.). As a result, a palladium thin film was completely formed in the through-hole without problems. Furthermore, haloing did not occur around the through-hole. Thereafter, with a current density of 2.5 A/dm$^2$, electro copper plating was so performed as to obtain a film thickness of 25 μm by using an electro copper plating bath containing 80 g/L of copper sulfate pentahydrate, 200 g/L of sulfuric acid, 60 ppm of chloride ion, 0.5 ml/L of copper sulfate plating additive THRU-CUP EPL-1-4A (made by C. Uyemura & Co., Ltd.), and 20 ml/L of THRU-CUP EPL-1-B (made by C. Uyemura & Co., Ltd.). As a result, an electro copper plating film was favorably deposited across the whole surface.

Example 10

The same treatment as that of Example 9 was repeated by 2000 cycles. Even in the 2000th cycle, an electro copper plating film was favorably deposited across the whole surface without problems. The amount of copper dissolution in the palladium colloidal solution after 2000 cycles was 0.5 ppm.

Comparative Example 9

For a four-layer substrate formed by a commercial product FR-4 in which a through-hole was provided (0.3 mmϕ, 1.6 mmt), treatment by the palladium colloidal solution with the composition shown in Comparative Example 5 in Table 2 was performed in accordance with the process shown in Table 3. Thereafter, treatment was performed at 50° C. for 3 minutes by using a direct plating bath WPD (made by C. Uyemura & Co., Ltd.). As a result, a palladium thin film was completely formed in the through-hole without problems. Furthermore, haloing did not occur around the through-hole. Thereafter, with a current density of 2.5 A/dm$^2$, electro copper plating was so performed as to obtain a film thickness of 25 μm by using an electro copper plating bath containing 80 g/L of copper sulfate pentahydrate, 200 g/L of sulfuric acid, 60 ppm of chloride ion, 0.5 ml/L of copper sulfate plating additive THRU-CUP EPL-1-4A (made by C. Uyemura & Co., Ltd.), and 20 ml/L of THRU-CUP EPL-1-B (made by C. Uyemura & Co., Ltd.). As a result, an electro copper plating film was favorably deposited across the whole surface.

Comparative Example 10

The same treatment as that of Comparative Example 9 was repeated by 2000 cycles. From the 1500th cycle, partial non-deposition occurred, i.e. electro copper plating was not deposited across the whole surface. The amount of copper dissolution in the palladium colloidal solution after 2000 cycles was 20 ppm.

Comparative Example 11

For a four-layer substrate formed by a commercial product FR-4 in which a through-hole was provided (0.3 mmϕ, 1.6 mmt), treatment by the alkaline Pd ion solution with the composition shown in Comparative Example 6 in Table 2 was performed in accordance with the process shown in Table 5. Thereafter, treatment was performed at 50° C. for 3 minutes by using a direct plating bath WPD (made by C. Uyemura & Co., Ltd.). As a result, a palladium thin film was not deposited at all in the through-hole. Thereafter, with a current density of 2.5 A/dm$^2$, electro copper plating was so performed as to obtain a film thickness of 25 μm by using an electro copper plating bath containing 80 g/L of copper sulfate pentahydrate, 200 g/L of sulfuric acid, 60 ppm of chloride ion, 0.5 ml/L of copper sulfate plating additive THRU-CUP EPL-1-4A (made by C. Uyemura & Co., Ltd.), and 20 ml/L of THRU-CUP EPL-1-B (made by C. Uyemura & Co., Ltd.). However, an electro copper plating film was not formed at all.

The invention claimed is:

1. A catalyst application solution for plating an insulating portion of an object to be plated comprising the insulating portion, the catalyst application solution comprising the following components:

(A) a water-soluble palladium compound selected from the group consisting of palladium oxide, palladium chloride, palladium nitrate, palladium acetate, sodium palladium chloride, potassium palladium chloride, ammonium palladium chloride, palladium sulfate, and tetraammine palladium chloride, in concentration of 0.0001 to 0.01 mol/L;

(B) a reducer selected from the group consisting of hypophosphorous acid and salt thereof, boron hydride and salt thereof, dimethylamine borane, and trimethylamine borane, in concentration of 0.005 to 1 mol/L;

(C) a dispersant selected from the group consisting of a polymer surfactant, an anionic surfactant, a cationic surfactant, and an amphoteric surfactant, in concentration of 0.01 to 10 g/L;

(D) a catechol in concentration of 0.01 to 50 g/L;

(E) a copper-oxidation inhibitor selected from the group consisting of ascorbic acid, glyoxylic acid, phosphorous acid, sulfurous acid, and salts thereof, and formaldehyde, in concentration of 0.001 to 0.5 mol/L; and (F) a pH buffering agent selected from the group consisting of citric acid, acetic acid, phosphoric acid, and salts thereof in concentration of 0.005 to 0.5 mol/L, and wherein the catalyst application solution has a pH of at least 4.

2. The catalyst application solution of claim 1, which does not contain Sn or a Sn compound.

3. The catalyst application solution of claim 1, which further comprises NaCl.

4. The catalyst application solution of claim 1, which further comprises HCl.

5. The catalyst application solution of claim 1, wherein the buffering agent is selected from the group consisting of citric acid, phosphoric acid, and salts thereof.

6. The catalyst application solution of claim 1, which has a pH of 5.9 to 7.3.

7. The catalyst application solution of claim 5, which has a pH of 5.9 to 7.3.

8. The catalyst application solution of claim 1, wherein the buffering agent is added in an effective amount to keep the pH of the catalyst application solution to be at least 4.

9. The catalyst application solution of claim 6, wherein the buffering agent is added in an effective amount to keep the pH of the catalyst application solution to be 5.9 to 7.3.

10. The catalyst application solution of claim 7, wherein the buffering agent is added in an effective amount to keep the pH of the catalyst application solution to be 5.9 to 7.3.

11. The catalyst application solution of claim 1, which is for electroless plating.

12. The catalyst application solution of claim 1, which is for direct plating.

13. An electroless plating method for carrying out electroless plating for an insulating portion of an object to be plated comprising the insulating portion, the method comprising:

applying a palladium catalyst to a surface of the insulating portion by performing palladium catalyst application treatment for a surface of the object to be plated by utilizing the catalyst application solution of claim 1, and thereafter, forming an electroless plating film on the surface of the insulating portion to which the palladium catalyst is applied.

14. A direct plating method for carrying out electroplating for an insulating portion of an object to be plated comprising the insulating portion, the method comprising:

applying a palladium catalyst to a surface of the insulating portion by performing palladium catalyst application treatment for a surface of the object to be plated by utilizing the catalyst application solution of claim 1, thereafter, forming a palladium electrical conductor layer on the insulating portion by a palladium electrical-conductor layer forming solution comprising a palladium compound, an amine compound, and a reducer with utilization of the applied palladium as a catalyst, and thereafter, forming an electroplating film directly on the palladium electrical-conductor layer.

* * * * *